United States Patent [19]

Nilssen

[11] Patent Number: 4,461,980

[45] Date of Patent: Jul. 24, 1984

[54] PROTECTION CIRCUIT FOR SERIES RESONANT ELECTRONIC BALLASTS

[76] Inventor: Ole K. Nilssen, Caesar Dr., Rte. 5, Barrington, Ill. 60010

[21] Appl. No.: 411,263

[22] Filed: Aug. 25, 1982

[51] Int. Cl.[3] ..... H05B 41/29

[52] U.S. Cl. ..... 315/225; 315/119; 315/DIG. 7; 328/7; 363/56

[58] Field of Search ..... 315/119, 127, 225, 309; 315/DIG. 7; 361/94, 99; 307/326; 328/7; 363/56

[56] References Cited

U.S. PATENT DOCUMENTS 3,889,153 6/1975 Pierce ..... 315/DIG. 7

4,392,087 7/1983 Zansky ..... 315/225 X 4,398,126 8/1983 Zuchtriegel ..... 315/127

*Primary Examiner*—Eugene R. Laroche

[57] ABSTRACT

For protection against potentially serious electric shock hazard to a person removing and/or replacing a fluorescent lamp in a fluorescent lighting fixture having an inverter-type electronic ballast, a special protection circuit is provided as part of this ballast.

This protection circuit operates to disable the ballast inverter within about one second after a fluorescent lamp is removed from at least one of its sockets, thereby removing the potentially hazardous voltage present at the fixture's lamp sockets.

9 Claims, 1 Drawing Figure

PROTECTION CIRCUIT FOR SERIES RESONANT ELECTRONIC BALLASTS

BACKGROUND OF THE INVENTION

1. Field of the Invention

The present invention relates to series-resonance-loaded inverter-type ballasts for fluorescent lamps, particularly of a type having built-in means for turning itself off in case lamp current fails to flow.

2. Description of Prior Art

Inverter-type fluorescent lamp ballasts using series-resonant means for generating very high lamp starting and operating voltages have been previously described—as, for instance, in a previous patent application of mine entitled Inverter Circuits, which application was filed on Aug. 14, 1980 and given Ser. No. 06/178,107.

However, to the best of my knowledge, no published information exists relative to such ballasts having been provided with means to turn itself off in case lamp current fails to flow.

Rationale Related to the Invention

With most fluorescent lighting fixtures, the voltages required at the sockets to start the fluorescent lamps are so high as potentially to constitute a substantial electric shock hazard to persons having to service such fixtures. To mitigate this hazard, whenever socket voltages exceed certain levels, protective measures have to be provided.

The essential shock hazard problem associated with a fluorescent lighting fixture relates to the situation where a person, who may be in contact with earth ground, is holding onto one end of a fluorescent lamp while the other end of the lamp is inserted into its socket.

Consequently, by using lamp sockets of a type that provides for disconnection of the socket voltage source whenever a lamp is removed, acceptably safe operation will result. Alternatively, electrical isolation can be provided between ground and the ballast output to the lamp sockets.

In most applications of inverter-type ballasts, the resulting socket voltages are high enough to require protective measures; and the only presently available commercially practicable solution is that of using an isolation transformer to provide electrical isolation between the power line input (ground) and the ballast output to the lamp sockets. While this solution is indeed safety-wise acceptable, it involves substantial penalties in terms of ballast cost, size and weight, as well as in overall ballast efficiency.

Of course, circuit-interrupting sockets could be used; but that solution would require non-standard and substantially more costly lamp sockets in addition to extensive added wiring within the fixture. Thus, at least for inverter-type ballasts, the use of circuit-interrupting lamp sockets would constitute an even less attractive solution than that of using an isolation transformer.

Based on the background outlined above, subject invention relates to a very cost-effective electronic means of providing a function substantially equivalent to that provided by circuit-interrupting lamp sockets.

SUMMARY OF THE INVENTION

Objects of the Invention

A first object of the present invention is that of providing a fluorescent lamp ballast with automatic means for turning off its output voltage in case output current fails to flow.

A second object is that of providing an inverter-type ballast wherein the inverter output voltage automatically is turned off after a brief time period in case output current fails to flow.

A third object is that of providing for fluorescent lighting fixtures electronic means to provide the near-equivalent function of circuit-interrupting lamp sockets.

A fourth object is that of providing a fluorescent lamp ballast with reduced potential for exhibiting electric shock hazard.

These as well as other objects, features and advantages of the present invention will become apparent from the following description and claims.

Brief Description

The present invention relates to the proposition of providing means built into a fluorescent lamp ballast by which the voltage output from the ballast is turned off in case ballast output current falls below a certain level.

More specifically and according to the preferred embodiment of the invention, a ballast of the type described above contains the following key elements:

(a) A source of DC voltage;

(b) A self-oscillating inverter connected with said source of DC voltage and operative to provide a substantially squarewave AC output voltage;

(c) A resonant inductor-capacitor series-combination connected directly across the output of said inverter;

(d) Means for connecting a fluorescent lamp in parallel with the capacitor of said series-combination; and (e) Means for automatically turning the inverter off after a brief time period, except if a predetermined minimum amount of lamp current is flowing.

The method used for turning off the self-oscillating inverter is that of using a thermally responsive bimetallic switching means to cause a short circuit in the feedback loop—with said switching means being actuated by a current that is only present if the lamp load is not present.

More specifically, a voltage clamping means is connected in circuit with the resonant series-combination, and clamping current is arranged to flow whenever the lamp load is not present. (Otherwise, the lamp acts as a voltage clamping means.) The resulting clamping current is used to generate heat by which to actuate the thermally responsive switching means.

Thus, if clamping current is allowed to flow for a time long enough for the thermally responsive switching means to close, the inverter feedback will be shorted and inverter oscillation will stop. The response time is adjusted to be on the order of one second; which is long enough to permit a properly functioning fluorescent lamp to get started after initial circuit power-up, but short enough to prevent high ballast output voltages from appearing long enough to present significant shock hazard in an actual usage situation.

In other words, as soon as lamp current starts flowing, clamping current stops flowing; and the thermally responsive switching means will then not get the heating power required to cause the indicated shorting in the inverter feedback loop.

The inverter is of a type that needs to be triggered into oscillation. Upon initial power-up, triggering occurs nearly at once. However, arrangements have been provided by which re-triggering after a shut-off will only occur after an adjustably long time period.

DESCRIPTION OF THE PREFERRED EMBODIMENT

Figure 1:
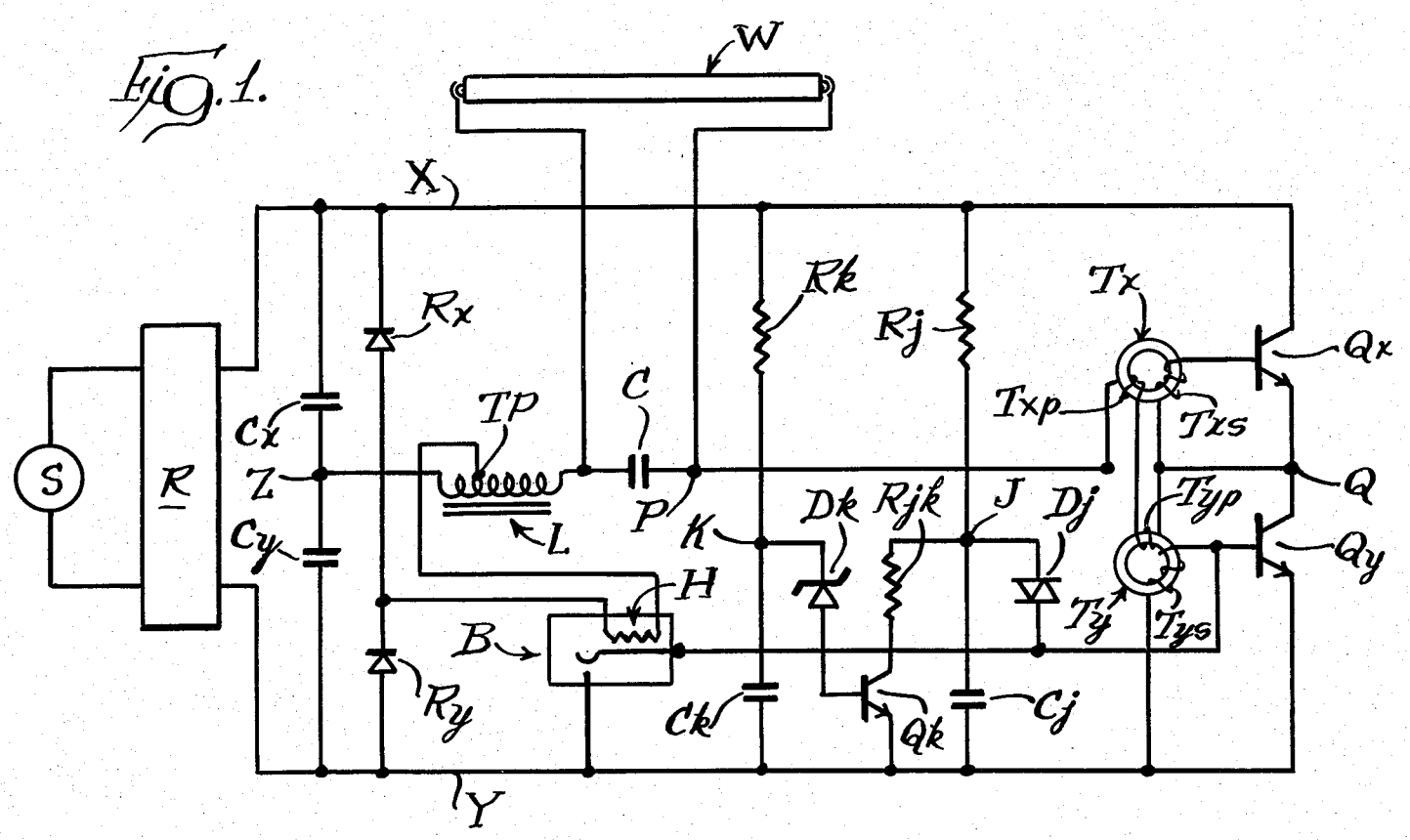
FIG. 1 schematically illustrates the preferred embodiment of the invention, showing an inverter-type ballast adapted to operate an instant-start fluorescent lamp.

In FIG. 1, a source S of 120 Volt/60 Hz voltage is applied to a rectifier means R, the rectified output of which is applied to inverter bus bars X and Y, respectively—with bus bar X carrying the B+ voltage. An energy-storing filter capacitor Cx is connected between bus bar X and junction Z; another energy-storing filter capacitor Cy is connected between junction Z and bus bar Y.

A switching transistor Qx is connected with its collector to bus bar X and with its emitter to junction Q; another switching transistor Qy is connected with its collector to junction Q and with its emitter to bus bar Y.

A saturable feedback transformer Tx has a primary winding Txp and a secondary winding Txs; another saturable feedback transformer Ty has a primary winding Typ and a secondary winding Tys.

Primary windings Txp and Typ are connected in series with one another and between junction Q and another junction P.

Secondary winding Txs is connected between the base and the emitter of transistor Qx; secondary winding Tys is connected between the base and the emitter of transistor Qy.

A high-quality high-frequency capacitor C and a high-quality high-frequency inductor L are connected in series with one another and between junction Z and junction P.

Inductor L has a tap-point TP, which is connected through a resistive heater H of a bimetallic switch B to the anode of a high-frequency rectifier Rx and to the cathode of a similar rectifier Ry. The cathode of rectifier Rx is connected to bus bar X; the anode of rectifier Ry is connected to bus bar Y.

A load W, which is an instant-start fluorescent lamp, is disconnectably connected across capacitor C.

A resistor Rj is connected between bus bar X and a junction J; a capacitor Cj is connected between junction J and bus bar Y; and a Diac Dj is connected between junction J and the base of transistor Qy.

Another resistor Rk is connected between bus bar X and a junction K; a capacitor Ck is connected between junction K and bus bar Y; and a Zener diode Dk is connected between junction K and the base of a transistor Qk, which Zener diode has its cathode connected to junction K.

Transistor Qk has its emitter connected to bus bar Y and its collector connected to junction J through a resistor Rjk.

The operation of the circuit of FIG. 1 may be explained as follows.

The two transistors Qx and Qy are operated as a self-oscillating half-bridge inverter: with timed positive current feedback being provided by saturable feedback transformers Tx and Ty; with B+ power being provided from a center-tapped DC power supply, which power supply consists of AC power source S, rectifier means R and series-connected filter capacitors Cx and Cy, which capacitors are of substantially equal capacitance and connected together at junction Z to form a power supply center-tap; and with circuit oscillation being initiated by way of the trigger sub-circuit consisting of resistor Rj, which charges capacitor Cj from B+, and which capacitor is periodically discharged into the base terminal of transistor Qy by way of Diac Dj.

The output of the inverter is provided between junctions P and Z, and is a substantially squarewave voltage. This squarewave output voltage is applied across the L-C series-combination of inductor L and capacitor C.

The L-C series-combination is resonant at or near the fundamental frequency of the inverter squarewave voltage output. As a consequence, Q-multiplication takes place; and the voltage developed across inductor L and/or capacitor C becomes very large in magnitude in comparison with the magnitude of the fundamental frequency component of the squarewave voltage impressed across the L-C series-combination.

Inductor L is provided with a tap-point TP, which tap-point is connected to the DC power supply by way of the heater H of the bimetallic switch B as well as by way of a pair of high frequency rectifiers Rx and Ry. With rectifier polarities as shown, and if the voltage at the tap-point exceeds the voltage to which filter capacitors Cx or Cy are charged, current will flow from the tap-point to these capacitors. In effect, with capacitors Cx and Cy being of relatively large capacitance, rectifiers Rx and Ry will provide a clamp on the maximum voltage that can be developed at tap-point TP; which is nearly equivalent to that of providing a clamp on the voltage that can develop across inductor L and/or across capacitor C.

Thus, with the above-described voltage clamping means, the voltages that will develop across L and/or C can be limited to levels below those which would otherwise have been the case—the exact levels being determined mainly by the positioning on L of the tap-point. Consequently, even with no circuit loading present, the voltage developed across L and/or C can be limited in magnitude to a point well below the level where component destruction would be apt to take place or where circuit power dissipation would be excessive.

Loading of the inverter is accomplished by connecting an instant-start fluorescent lamp W across capacitor C of the series-resonant circuit—although such loading could also be accomplished by connecting the load in parallel circuit with inductor L. However, connecting the load across the capacitor has the advantage of obtaining a nearly sinusoidal output voltage—substantially free of all the harmonic components present on the original squarewave.

The positioning of the tap point on L is determined by the voltage required for properly starting the instant-start fluorescent lamp W. Thus, before the lamp starts, current is flowing from the tap point and through heater H of bimetallic switch B.

After the lamp has started, the voltage across it reduces to a much lower magnitude (typically to about one third of the voltage required for starting), and clamping current now ceases to flow.

However, had the lamp not started, or had the lamp not been present, clamping current would have continued to flow; and the heat generated in heater H of the bimetallic switch B would eventually (after about a second or so) have become enough to cause the switch to close.

The closing of the switch would cause a short-circuit to be presented across the base-emitter junction of transistor Qy; which short-circuit would have the effect of stopping the inverter from oscillating.

Of course, when the inverter stops oscillating, the clamping current ceases to flow, and therefore the bimetallic switch will eventually open again. At this point, if the requisite triggering pulses are provided, the inverter will re-start its oscillation; and clamping current will again start flowing—with the cycle thereafter repeating itself indefinitely.

By arranging for the cycle to have an appreciable period associated with the state of non-oscillation versus the period associated with the state of oscillation, a significant reduction occurs in the net power dissipation that results when the circuit is non-properly loaded as compared with a situation without cycling—that is, compared with continuous oscillation.

However, using just a simple bimetallic switch as indicated, the attainable ratio of non-oscillating period versus oscillating period is limited within a very narrow range. To increase the attainable period of non-oscillation, means have been provided for interfering with the process of re-triggering the circuit after its oscillation has been stopped. That way, the ratio of non-oscillating period to oscillating period can be made as large as desirable.

The time it takes for the circuit to be triggered into oscillation is determined by the time it takes to provide the first trigger pulse to the base of transistor Qy; and the time it takes for this to occur is directly dependent upon the time it takes to charge capacitor Cj to a voltage high enough to cause voltage break-over of the Diac Dj. For a given Diac and for given values of Rj and Cj, the time it takes for capacitor Cj to reach this break-over voltage substantially depends on the magnitude of the resistance present between junction J and bus bar Y.

(In fact, with the magnitude of that resistance being sufficiently small, the voltage on capacitor Cj will never reach a level high enough to cause Diac break-over.)

If transistor Qk receives an adequate amount of base current, the resistance between junction J and bus bar Y depends essentially only on the magnitude of resistor Rjk; which magnitude is chosen such that the time required for charging capacitor Cj to a voltage of adequate magnitude for causing Diac break-over is relatively long compared with the time required if transistor Qk were not provided with an adequate amount of base current.

After initial circuit power-up, the time required before transistor Qk receives any significant amount of base current depends on the length of time it takes for capacitor Ck to charge up to a voltage high enough to permit significant current to flow through Zener diode Dk.

Thus, immediately after power-up, capacitor Cj will be charged through Rj without being affected by the loading caused by transistor Qk; and the circuit will receive triggering pulses at a relatively rapid rate (typically several trigger pulses per second). However, about one second after power-up, capacitor Ck is charged to the point of causing base current to flow to transistor Qk; which means that the triggering rate has now been reduced substantially—to about one pulse per 30 seconds.

(By substituting a short-circuit for resistor Rjk, the triggering action can be completely eliminated after the initial power-up sequence; and the inverter circuit would have to be totally shut down before it could be re-triggered into operation. This arrangement is safety-wise desirable in some situations.)

In the preferred embodiment, the parameters of Rk, Ck and Dk are chosen such that it takes about one second after power-up for base current to start flowing to Qk; while Rj, Cj and Dj are chosen such that it takes only about 0.2 second to provide the first trigger pulse to the base of transistor Qy and thereby to initiate inverter circuit oscillation.

Consequently, circuit power-up will not be affected by the action of the trigger-delay sub-circuit (which is the sub-circuit consisting of Rk, Ck, Dk, Qk and Rjk). However, if somehow the oscillation has been interrupted by means other than that of removing the B+ voltage (such as by action of the bimetallic switch), circuit re-triggering will be delayed by an amount principally determined by the value of Rjk. In the preferred embodiment, this time delay is chosen to be about 30 seconds.

In other words, with a properly functioning fluorescent lamp connected, the preferred embodiment of FIG. 1 will operate in a normal fashion as a high-frequency inverter power supply powering a fluorescent lamp (which is to say, as an electronic ballasting means for a fluorescent lamp).

However, after initial inverter power-up, if the lamp should fail to start within about one second, the inverter oscillation is automatically stopped, thereby removing the high-frequency lamp-intended-voltage from the lamp's sockets (which removal has important implications in respect to mitigating electric shock hazards) as well as substantially eliminating any power drawn by the inverter.

After a period of about 30 seconds, inverter oscillation is re-initiated; but only once more to be stopped after about one second if the lamp should still fail to start.

Similar actions occur if the lamp is simply removed from its sockets during operation.

It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. A ballasting means for a gas discharge lamp, said ballasting means being adapted to be powered from an ordinary electric utility power line and comprising:

rectification means connected in circuit with said power line and operative to supply a DC voltage;

inverter means operative to convert said DC voltage into a substantially squarewave voltage, said squarewave voltage having a fundamental frequency and being provided across a pair of squarewave output terminals;

an L-C circuit comprising an inductor and a capacitor effectively connected in series with one another, said L-C circuit being resonant at or near said fundmental frequency and connected across said pair of squarewave output terminals;

connect means operative to permit connection of said lamp in parallel circuit with said capacitor;

voltage limiting means operative, whenever said lamp is not effectively connected in parallel with said capacitor, to limit the voltage developed across said capacitor to a magnitude lower than that dictated by the L-C circuit's Q-multiplication effect, but yet high enough to provide for effective lamp starting, said magnitude never-the-less being of a level high enough to represent a serious electric shock hazard to humans; and safety means operative, whenever said voltage limiting means has been limiting the voltage developed across said capacitor for but a relatively brief period, to disable said inverter means, thereby to reduce the magnitude of the voltage developed across said capacitor to a level that is not high enough to represent a serious electric shock hazard to humans.

2. The ballasting means of claim 1 wherein said relatively brief period of time is on the order of one second.

3. The ballasting means of claim 2 and restoring means operative to restore the inverter to operation after a pre-determined length of time after it has been disabled by said safety means.

4. The ballasting means of claim 3 wherein said pre-determined length of time is on the order of 30 seconds.

5. A ballasting means for a gas discharge lamp, said ballasting means comprising:

a source of DC voltage;

an inverter operative to convert said DC voltage into a substantially squarewave voltage, said squarewave voltage having a fundamental frequency and being provided across a pair of squarewave output terminals;

an L-C circuit comprising an inductor and a capacitor effectively connected in series with one another, said L-C circuit being resonant at or near said fundamental frequency and connected across said pair of squarewave output terminals;

connect means operative to permit connection of said lamp in circuit with said capacitor;

clamping means operative, whenever the lamp is not effectively connected in circuit with said capacitor, to extract energy from said resonant L-C circuit, thereby to limit the voltage developed across said capacitor to a magnitude lower than that dictated by the L-C circuit's Q-multiplying effect, yet appropriate for effective lamp starting, said magnitude never-the-less being of a level high enough to represent a serious electric shock hazard to humans; and safety means operative, whenever said clamping means has been extracting energy from said resonant L-C circuit for more than a relatively brief time period, to reduce the magnitude of the voltage developed across said capacitor to a level that does not represent a serious electric shock hazard to humans.

6. A ballasting means for a gas discharge lamp, comprising:

a source of DC voltage;

an inverter operative to convert said DC voltage into an AC voltage provided across a pair of output terminals, said AC voltage having a frequency;

an L-C series-circuit resonant at or near said frequency and connected across said pair of output terminals;

connect means operative to permit connection of said lamp in loading relationship with said L-C series-circuit;

clamping means operative, whenever the loading provided for said L-C series-circuit by said lamp is lower than a given level, to extract energy from said L-C series-circuit, thereby preventing the voltages developed within said L-C series-circuit, as well as the current drawn by said L-C series-circuit, from reaching magnitudes that might be damaging to components in said L-C series-circuit or in said inverter, yet in spite of the presence of said clamping means the magnitudes of the voltages developed within said L-C series-circuit will be high enough to constitute a serious electric shock hazard to humans; and safety means operative, whenever said clamping means has been extracting energy from said L-C series-circuit for longer than a relatively brief period of time, to effect a reduction in magnitudes of the voltages developed within said L-C series-circuit to a level low enough not to constitute a serious electric shock hazard to humans.

7. The ballasting means of claim 6 wherein said reduction in magnitudes is accomplished by disablement of the inverter.

8. The ballasting means of claim 7 wherein said inverter includes a pair of alternatingly switching power transistors capable of continuous self-oscillating operation once having been triggered and until being manifestly disabled, and where said disablement is effected by momentarily shorting the base-emitter junction of one of these transistors.

9. The ballasting means of claim 8 wherein said inverter also includes means for automatic re-triggering of oscillation some pre-determined time after disablement.

* * * * *